US009404310B1

(12) United States Patent
Sani et al.

(10) Patent No.: US 9,404,310 B1
(45) Date of Patent: Aug. 2, 2016

(54) POLYCRYSTALLINE DIAMOND COMPACTS INCLUDING A DOMED POLYCRYSTALLINE DIAMOND TABLE, AND APPLICATIONS THEREFOR

(71) Applicant: US Synthetic Corporation, Orem, UT (US)

(72) Inventors: Mohammad N Sani, Orem, UT (US); Alberto Castillo, Orem, UT (US); Mark P Chapman, Provo, UT (US); Jair J Gonzalez, Provo, UT (US)

(73) Assignee: US Synthetic Corporation, Orem, UT (US)

( * ) Notice: Subject to any disclaimer, the term of this patent is extended or adjusted under 35 U.S.C. 154(b) by 575 days.

(21) Appl. No.: 13/771,364

(22) Filed: Feb. 20, 2013

Related U.S. Application Data

(60) Provisional application No. 61/605,328, filed on Mar. 1, 2012.

(51) Int. Cl.
*E21B 10/567* (2006.01)
*E21B 10/55* (2006.01)
*E21B 10/52* (2006.01)

(52) U.S. Cl.
CPC ..... *E21B 10/5676* (2013.01); *E21B 10/55* (2013.01); *E21B 10/567* (2013.01); *E21B 10/52* (2013.01)

(58) Field of Classification Search
CPC ... E21B 10/5673; E21B 10/55; E21B 10/567; E21B 10/52; E21B 10/26; E21B 10/46; E21B 10/54; E21B 10/5676
See application file for complete search history.

(56) References Cited

U.S. PATENT DOCUMENTS

| | | | | |
|---|---|---|---|---|
| 3,269,470 | A * | 8/1966 | Kelly, Jr. | E21B 10/56 175/415 |
| 5,437,343 | A * | 8/1995 | Cooley et al. | 175/431 |
| 5,871,060 | A * | 2/1999 | Jensen et al. | 175/420.2 |
| 6,050,354 | A * | 4/2000 | Pessier et al. | 175/430 |
| 7,475,744 | B2 | 1/2009 | Pope | |
| 7,628,233 | B1 * | 12/2009 | Hall et al. | 175/426 |
| 7,690,442 | B2 * | 4/2010 | Portwood et al. | 175/57 |
| 7,866,418 | B2 | 1/2011 | Bertagnolli et al. | |
| 8,034,136 | B2 * | 10/2011 | Sani | B22F 7/08 51/293 |
| 8,499,860 | B2 * | 8/2013 | Shen et al. | 175/426 |

(Continued)

OTHER PUBLICATIONS

Sneddon, M.V., et al. "Polycrystalline Diamond: Manufacture, Wear Mechanisms, and Implications for Bit Design", Journal of Petroleum Technology, Dec. 1988, pp. 1593-1601.

(Continued)

*Primary Examiner* — Daniel P Stephenson
(74) *Attorney, Agent, or Firm* — Dorsey & Whitney LLP

(57) ABSTRACT

Embodiments of the invention relate to polycrystalline diamond compacts ("PDCs") including a domed polycrystalline diamond ("PCD") table that exhibit improved wear resistance and/or thermal stability. In an embodiment, a PDC includes a substrate having an interfacial surface, and a domed PCD table bonded to the interfacial surface of the substrate. The domed PCD table includes an exterior, convex generally cylindrical peripheral surface extending away from the interfacial surface of the substrate. The domed PCD table further includes a domed portion defining an upper, convex generally spherical surface, and an optional chamfer extending between the exterior, convex generally cylindrical peripheral surface and the upper, convex generally spherical surface.

22 Claims, 14 Drawing Sheets

(56) References Cited

U.S. PATENT DOCUMENTS

| | | | | |
|---|---|---|---|---|
| 8,589,124 | B2 * | 11/2013 | Huang | E21B 10/00 175/24 |
| 8,622,155 | B2 * | 1/2014 | Hall et al. | 175/431 |
| 8,714,285 | B2 * | 5/2014 | Hall et al. | 175/431 |
| 8,833,492 | B2 * | 9/2014 | Durairajan et al. | 175/430 |
| 8,960,337 | B2 * | 2/2015 | Hall et al. | 175/426 |
| 2004/0112650 | A1 * | 6/2004 | Moseley | 175/426 |
| 2008/0011522 | A1 * | 1/2008 | Hall et al. | 175/434 |
| 2008/0099250 | A1 * | 5/2008 | Hall et al. | 175/426 |
| 2008/0314647 | A1 * | 12/2008 | Hall et al. | 175/430 |

OTHER PUBLICATIONS

Sneddon, M.V., et al. "Recent Advances in Polycrystalline Diamond (PCD) Technology Open New Frontiers in Drilling", Society of Petroleum Engineers, Sep. 27, 30 1987, pp. 1-13.

U.S. Appl. No. 12/185,457, filed Aug. 4, 2008, Vail, et al.

U.S. Appl. No. 61/605,328, filed Mar. 1, 2012, Vail et al.

* cited by examiner

POLYCRYSTALLINE DIAMOND COMPACTS INCLUDING A DOMED POLYCRYSTALLINE DIAMOND TABLE, AND APPLICATIONS THEREFOR

CROSS-REFERENCE TO RELATED APPLICATIONS

This application claims priority to U.S. Provisional Application No. 61/605,328 filed on 1 Mar. 2012, the disclosure of which is incorporated herein, in its entirety, by this reference.

BACKGROUND

Wear-resistant, polycrystalline diamond compacts ("PDCs") are utilized in a variety of mechanical applications. For example, PDCs are used in drilling tools (e.g., cutting elements, gage trimmers, etc.), machining equipment, bearing apparatuses, wire-drawing machinery, and in other mechanical apparatuses.

PDCs have found particular utility as superabrasive cutting elements in rotary drill bits, such as roller-cone drill bits and fixed-cutter drill bits. A PDC cutting element typically includes a superabrasive diamond layer commonly known as a diamond table. The diamond table is formed and bonded to a substrate using a high-pressure/high-temperature ("HPHT") process. The PDC cutting element may be brazed directly into a preformed pocket, socket, or other receptacle formed in a bit body. The substrate may often be brazed or otherwise joined to an attachment member, such as a cylindrical backing. A rotary drill bit typically includes a number of PDC cutting elements affixed to the bit body. It is also known that a stud carrying the PDC may be used as a PDC cutting element when mounted to a bit body of a rotary drill bit by press-fitting, brazing, or otherwise securing the stud into a receptacle formed in the bit body.

Conventional PDCs are normally fabricated by placing a cemented carbide substrate into a container with a volume of diamond particles positioned on a surface of the cemented carbide substrate. A number of such containers may be loaded into an HPHT press. The substrate(s) and volume(s) of diamond particles are then processed under HPHT conditions in the presence of a catalyst material that causes the diamond particles to bond to one another to form a matrix of bonded diamond grains defining a polycrystalline diamond ("PCD") table. The catalyst material is often a metal-solvent catalyst (e.g., cobalt, nickel, iron, or alloys thereof) that is used for promoting intergrowth of the diamond particles.

In one conventional approach, a constituent of the cemented carbide substrate, such as cobalt from a cobalt-cemented tungsten carbide substrate, liquefies and sweeps from a region adjacent to the volume of diamond particles into interstitial regions between the diamond particles during the HPHT process. The cobalt acts as a metal-solvent catalyst to promote initial intergrowth between the diamond particles, which results in formation of a matrix of bonded diamond grains having diamond-to-diamond bonding therebetween. Interstitial regions between the bonded diamond grains are occupied by the metal-solvent catalyst.

The presence of the metal-solvent catalyst in the PCD table is believed to reduce the thermal stability of the PCD table at elevated temperatures experienced during drilling a subterranean rock formation. For example, the metal-solvent catalyst is believed to cause chipping or cracking of the PCD table during drilling or cutting operations, which consequently can degrade the mechanical properties of the PCD table or cause failure. Additionally, some of the diamond grains can undergo a chemical breakdown or back-conversion to graphite via interaction with the metal-solvent catalyst.

One conventional approach for improving the thermal stability of PDCs is to at least partially remove the metal-solvent catalyst from the PCD table of the PDC by acid leaching. Despite the availability of a number of different PDCs, manufacturers and users of PDCs continue to seek improved thermally stable PDCs.

SUMMARY

Embodiments of the invention relate to PDCs including a domed PCD table that may exhibit improved wear resistance and/or thermal stability. The domed PCD table unexpectedly imparts increased wear resistance and/or thermal stability when employed as a shear cutter on a fixed-cutter rotary drill bit compared to a substantially planar PCD table. Such improved wear resistance and/or thermal stability may be improved even in the absence of subjecting the domed PCD table to leaching to remove a metal-solvent catalyst or a metallic infiltrant therefrom.

In an embodiment, a PDC includes a substrate having an interfacial surface, and a domed PCD table bonded to the interfacial surface of the substrate. The domed PCD table includes an exterior, convex generally cylindrical peripheral surface extending away from the interfacial surface of the substrate. The domed PCD table further includes a domed portion defining an upper, convex generally spherical surface, and an optional chamfer extending between the exterior, convex generally cylindrical peripheral surface and the upper, convex generally spherical surface.

In an embodiment, a rotary drill bit includes a bit body configured to engage a subterranean formation. The bit body includes a plurality of blades. The rotary drill bit further includes a plurality of PCD cutting elements (e.g., shear cutters). Each of the PCD cutting elements may be affixed to one of the blades. At least one of the PCD cutting elements includes a substrate having an interfacial surface, and a domed PCD table bonded to the interfacial surface of the substrate. The domed PCD table includes an exterior, convex generally cylindrical peripheral surface extending away from the interfacial surface of the substrate. The domed PCD table further includes a domed portion defining an upper, convex generally spherical surface. In some embodiments, the domed PCD table further includes a chamfer extending between the exterior, convex generally cylindrical peripheral surface and the upper, convex generally spherical surface.

Other embodiments include methods of manufacture and use, and applications utilizing the disclosed PDCs in various articles and apparatuses, such as various types of other rotary drill bits, machining equipment, and other articles and apparatuses.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the invention, wherein identical reference numerals refer to identical or similar elements or features in different views or embodiments shown in the drawings.

DETAILED DESCRIPTION

Embodiments of the invention relate to PDCs including a domed PCD table. The domed PCD table may unexpectedly impart increased wear resistance and/or thermal stability when employed as a shear cutter on a fixed-cutter rotary drill bit compared to a substantially planar PCD table. Such improved wear resistance and/or thermal stability may be improved even in the absence of subjecting the domed PCD table to leaching to remove a metal-solvent catalyst or a metallic infiltrant therefrom. The disclosed PDCs may be used in a variety of applications, such as rotary drill bits, machining equipment, and other articles and apparatuses.

Figure 1A:
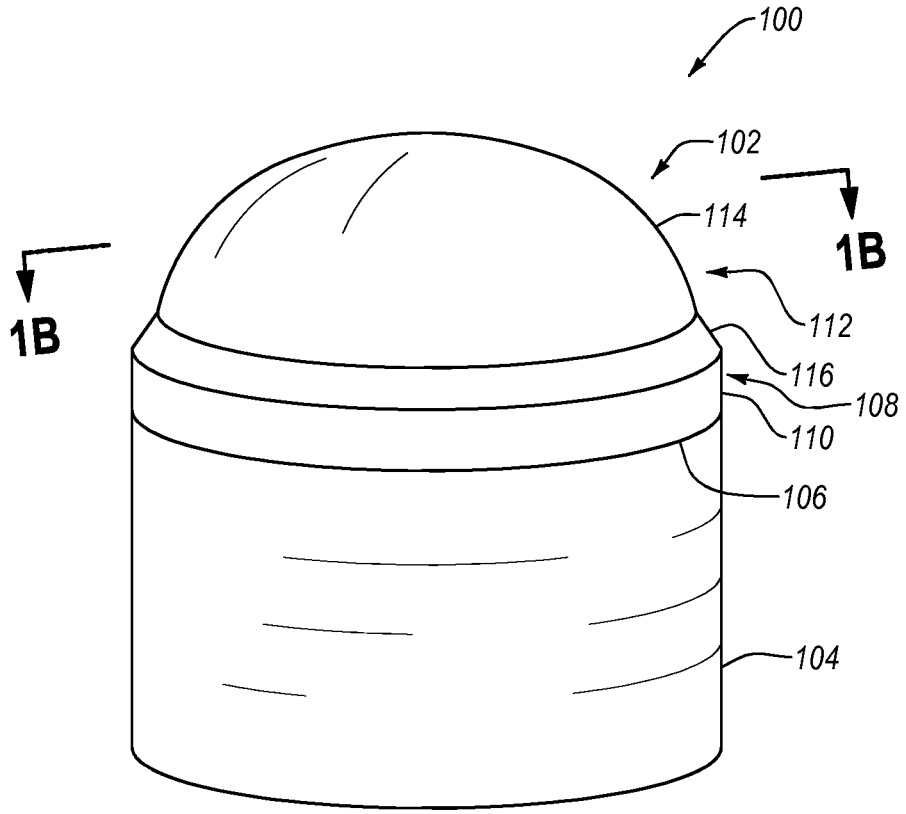
FIG. 1A is an isometric view of an embodiment of a PDC including a domed PCD table.
Figure 1B:
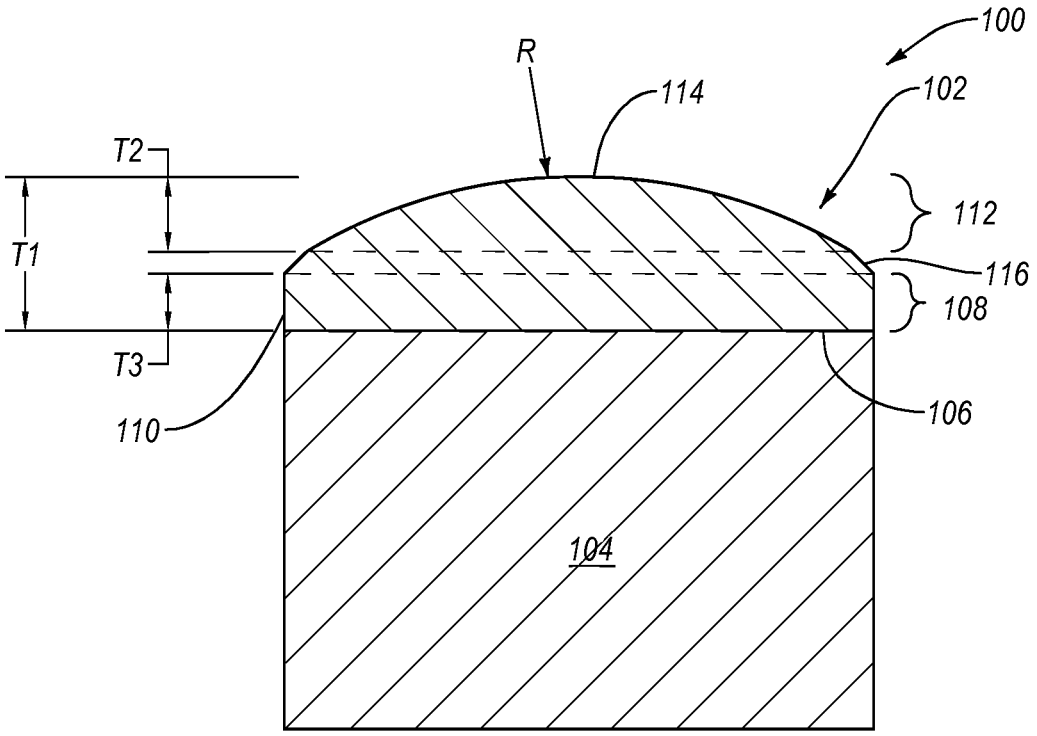
FIG. 1B is a cross-sectional view of the PDC shown in FIG. 1A taken along line 1B-1B thereof.
Figure 1C:
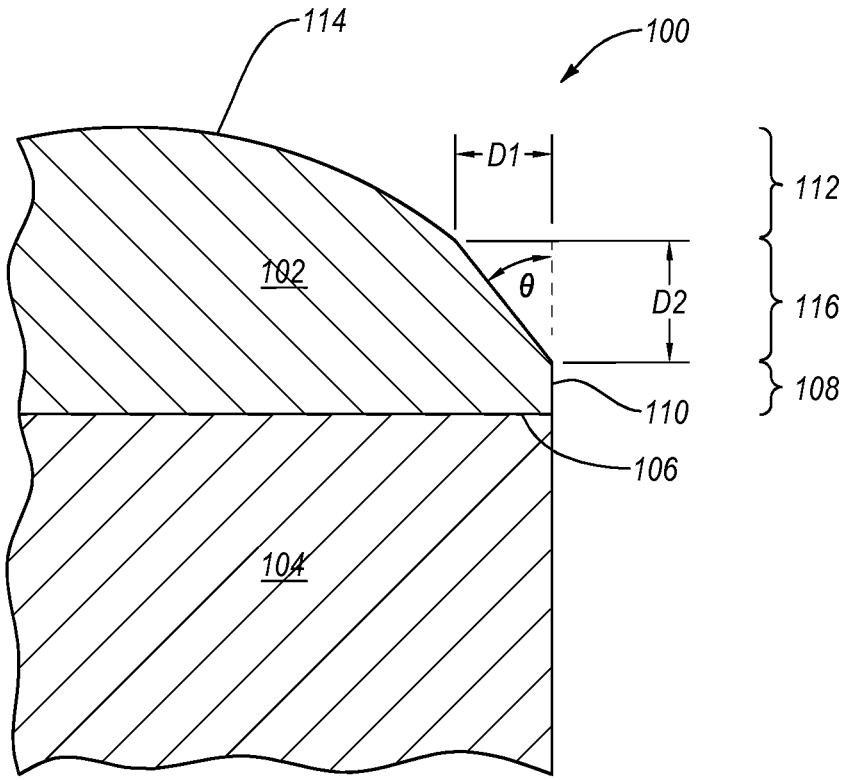
FIG. 1C is an enlarged cross-sectional view of the PDC shown in FIG. 1A taken along line 1B-1B thereof.

FIGS. 1A-1C are isometric, cross-sectional, and enlarged cross-sectional views, respectively, of an embodiment of a PDC 100. The PDC 100 includes a domed PCD table 102 and a substrate 104 having an interfacial surface 106 that is bonded to the domed PCD table 102. For example, the substrate 104 may include a cemented carbide substrate, such as tungsten carbide, tantalum carbide, vanadium carbide, niobium carbide, chromium carbide, titanium carbide, or combinations of the foregoing carbides cemented with iron, nickel, cobalt, or alloys thereof. In an embodiment, the cemented carbide substrate may include a cobalt-cemented tungsten carbide substrate.

Referring specifically to FIGS. 1B and 1C, in the illustrated embodiment, the interfacial surface 106 of the substrate 104 may be substantially planar. However, in other embodiments, the interfacial surface 106 may exhibit a selected nonplanar topography.

The domed PCD table 102 includes a plurality of directly bonded-together diamond grains exhibiting diamond-to-diamond bonding (e.g., $sp^3$ bonding) therebetween. The plurality of directly bonded-together diamond grains define a plurality of interstitial regions.

The domed PCD table 102 includes a generally cylindrical portion 108 bonded to the interfacial surface 106, which defines an exterior generally cylindrical peripheral surface 110 extending away from the interfacial surface 106. The domed PCD table 102 further includes a domed portion 112 defining an upper and exterior, convex generally spherical surface 114 (e.g., a portion of a generally spherical surface). In the illustrated embodiment, the domed PCD table 102 also includes a chamfer 116 that intersects and extends between the exterior generally cylindrical peripheral surface 110 of the generally cylindrical portion 108 and the exterior, convex generally spherical surface 114 of the domed portion 112. However, in other embodiments, the chamfer 116 may be omitted. At least a portion of the exterior, convex generally spherical surface 114, the exterior generally cylindrical peripheral surface 110, and the optional chamfer 116 may function as a working/cutting surface that engages a formation when used on a rotary drill bit. In other embodiments, the domed portion 112 may be non-spherical, rounded, ovoid, or generally convex.

Referring specifically to FIG. 1C, the geometry of the chamfer 116 may be defined by a lateral extent D1, an extension depth D2 that extends in an axial direction of the PDC 100, and a chamfer angle θ. For example, a ratio of the extension depth D2 to the lateral extent D1 may be about 0.5 to about 2 (e.g., about 1 to about 2, or about 0.5 to about 1, or about 1.5 to about 2) and the chamfer angle θ may be about 30° to about 60° (e.g., about 40° to about 50°, or about 45°).

In an embodiment, the domed PCD table 102 may be formed on the substrate 104 (i.e., integrally formed with the substrate 104) by HPHT sintering diamond particles on the substrate 104. In another embodiment, the domed PCD table 102 may be a preformed PCD table, such as an at least partially leached PCD table that is bonded to the substrate 104 in an HPHT process by infiltration of a metallic infiltrant therein from the substrate 104 or other source such as a disk of metallic infiltrant.

A metallic constituent (e.g., metal-solvent catalyst or a metallic infiltrant) infiltrated from the substrate 104 or other source during HPHT processing occupies some or substantially all of the interstitial regions of the domed PCD table 102 between bonded-together diamond grains. For example, cobalt from a cobalt-cemented tungsten carbide substrate may be infiltrated into the domed PCD table 102 that is preformed.

Figure 1D:
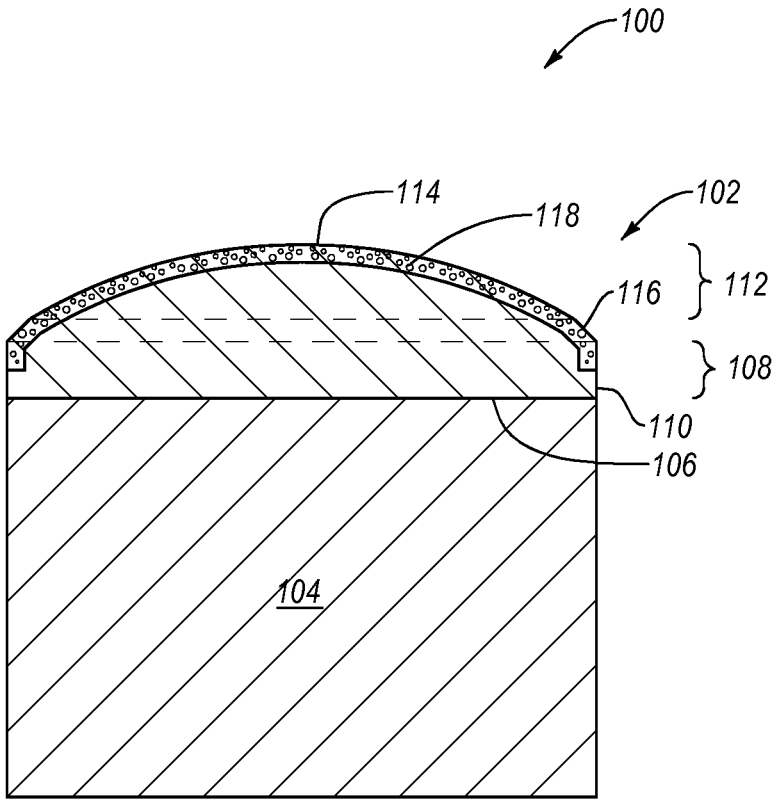
FIG. 1D is a cross-sectional view of the PDC shown in FIG. 1A taken along line 1B-1B thereof after subjecting the domed PCD table to a leaching process to form a leached region according to an embodiment.

Referring to FIG. 1D, in an embodiment, the domed PCD table 102 includes a leached region 118 remote from the substrate 104 for enhancing thermal stability. However, in other embodiments, such as shown in FIGS. 1A-1C, the domed PCD table 102 may be unleached. In the embodiment shown in FIG. 1D, the leached region 118 includes the convex generally spherical surface 114, the chamfer 116, and a portion of the generally cylindrical peripheral surface 110, with the leached region 118 extending inwardly to a selected leach depth d from those surfaces. However, in other embodiments, the leached region 118 may not include the chamfer 116 and/or extend into the generally cylindrical portion 108.

Generally, the selected leach depth d may be any suitable value. For example, in an embodiment, the selected leach depth d may be about 50 μm to about 100 μm, about 100 μm to about 300 μm, about 300 μm to about 500 μm, or greater than about 500 μm. In an embodiment, the selected leach depth d for the leached region 118 may be greater than 250 μm. For example, the selected leach depth d for the leached region 118 may be greater than 300 μm to about 425 μm, greater than 350 μm to about 400 μm, greater than 350 μm to about 375 μm, about 375 μm to about 400 μm, or about 500

μm to about 650 μm. The selected leach depth d for the leached region 118 may be measured inwardly from at least one of the convex generally spherical surface 114, the chamfer 116, or the generally cylindrical peripheral surface 110.

The leached region 118 has been leached to at least partially deplete the metal-solvent catalyst or metallic infiltrant therefrom that occupied the interstitial regions between the bonded diamond grains of the leached region 118. The leaching may be performed in a suitable acid (e.g., aqua regia, nitric acid, hydrofluoric acid, mixtures thereof, or combinations thereof) so that the leached region 118 is substantially free of the metal-solvent catalyst or metallic infiltrant. As a result of the metal-solvent catalyst or metallic infiltrant being depleted from the leached region 118, the leached region 118 may be relatively more thermally stable than the underlying portions of the domed PCD table 102.

Referring again to FIG. 1B, the domed PCD table 102 exhibits a maximum thickness T1, the domed portion 112 exhibits a maximum thickness T2, the generally cylindrical portion 108 exhibits a maximum thickness T3, and the exterior, convex generally spherical surface 114 of the domed portion 112 exhibits a radius of curvature R. In some embodiments, the maximum thickness T1 of the domed PCD table 102 may be less than or equal to the radius of curvature R of the exterior, convex generally spherical surface 114 of the domed portion 112, such as about 0.100 inch to about 0.300 inch, about 0.150 inch to about 0.200 inch, or about 0.150 inch to about 0.175 inch. In some embodiments, the radius of curvature R of the exterior, convex generally spherical surface 114 of the domed portion 112 may be about 0.400 inch to about 5.0 inch, such as about 0.400 inch to about 0.800 inch, about 0.400 inch to about 0.700 inch, about 0.400 inch to about 0.475 inch, about 1.0 inch to about 3.0 inch, about 2.0 inch to about 2.5 inch, about 2.1 inch to about 2.3 inch, or about 3.5 inch to about 4.5 inch. In some embodiments, the maximum thickness T2 of the domed portion 112 may be less than or equal to the radius of curvature R, such as about 0.9·R, about 0.8·R, about 0.7·R, about 0.7·R to about 0.9·R, about 0.35·R to about 0.6·R, or about 0.5·R to about 0.75·R. As another example, the maximum thickness T2 of the domed portion 112 may be about 0.400 inch to about 0.800 inch, such as 0.400 inch to about 0.700 inch. In some embodiments, a ratio of R/T1 may be about 2 to about 7, such as about 2 to about 6, about 3 to about 5, about 2.7 to about 3, or about 3.5 to about 5.5. In some embodiments, the maximum thickness T3 of the generally cylindrical portion 108 may be about 0.5 inch to about 0.150 inch, such as about 0.70 inch to about 0.100 inch, or about 0.85 inch to about 0.90 inch. It is noted that embodiments for the PDC 100 may exhibit any suitable and permissible combination of the aforementioned characteristics, such as R, T1, T2, T3, R/T, and chamfer dimensions (D1, D2, and θ). In a more detailed embodiment, T1 may be about 0.150 inch to about 0.200 inch, T2 may be about 0.050 inch to about 0.120 inch, T3 may be about 0.070 inch to about 0.090 inch, R may be about 0.450 inch to about 0.785 inch, D1 and D2 may be about 0.010 inch to about 0.025 inch, and θ may be about 42° to about 45°.

Figure 2A:
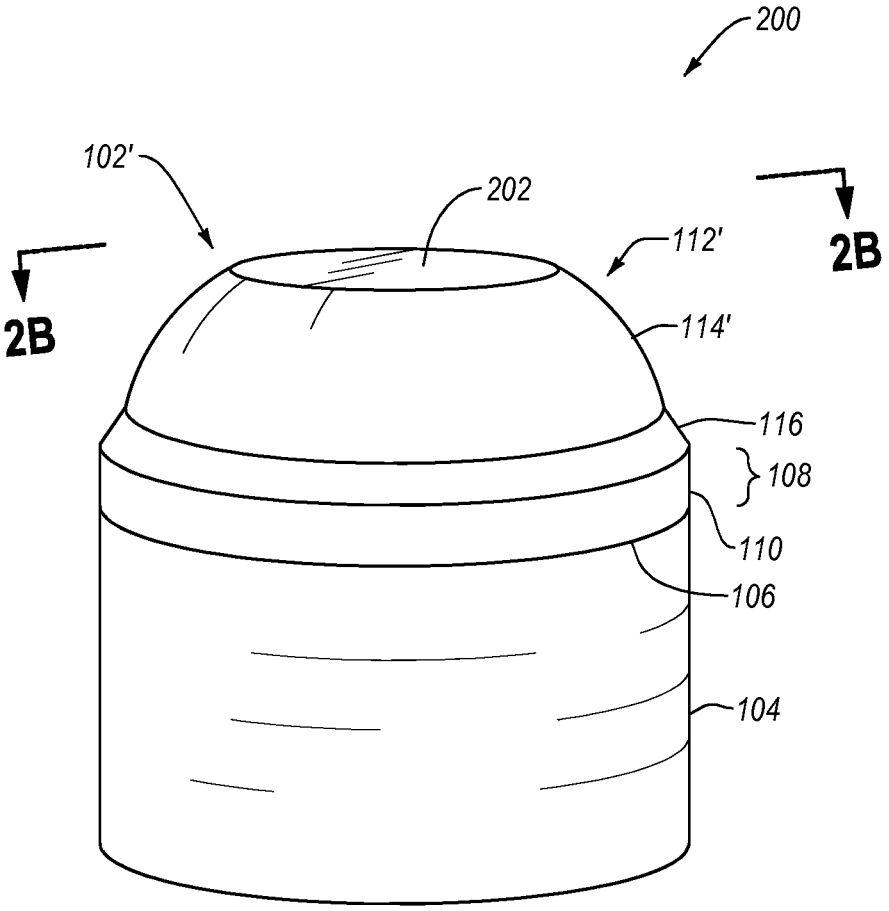
FIG. 2A is an isometric view of another embodiment of a PDC including a domed PCD table.
Figure 2B:
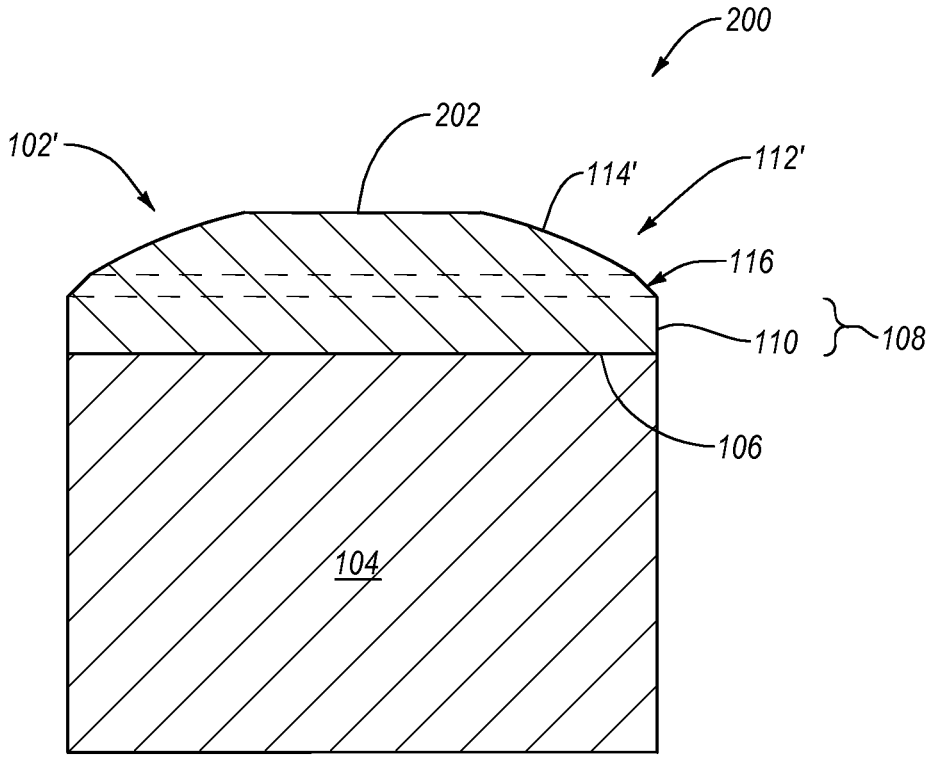
FIG. 2B is a cross-sectional view of the PDC shown in FIG. 2A taken along line 2B-2B thereof.

FIGS. 2A and 2B are isometric and cross-sectional views, respectively, of a PDC 200 according to another embodiment. The PDC 200 is similar to the PDC 100 shown in FIGS. 1A-1C. Therefore, in the interest of brevity, only the main differences between PDCs 100 and 200 are discussed below. The PDC 200 includes a domed PCD table 102' bonded to the interfacial surface 106 of the substrate 104. The domed PCD table 102' includes a domed portion 112' that includes an exterior, convex generally spherical surface 114'. However, the domed portion 112' exhibits a frustoconical geometry and has an upper, exterior substantially planar surface 202. In some embodiments, the upper, exterior substantially planar surface 202 may be centrally located relative to a central axis of the PDC, while in other embodiments, it may be offset from the central axis.

In the illustrated embodiment shown in FIGS. 2A and 2B, the domed PCD table 102' is not leached. However, in other embodiments, the domed PCD table 102' may be leached to deplete it of metal-solvent catalyst or metallic infiltrant to form a leached region. The leached region may extend inwardly to any of the previously disclosed selected leach depths from the exterior substantially planar surface 202, the exterior, convex generally spherical surface 114', and, optionally, the chamfer 116 and the generally cylindrical peripheral surface 110.

The domed PCD tables of the disclosed PDCs may exhibit an abrasion resistance at least partially characterized by a $G_{ratio}$, which may be enhanced at least partially due to the domed geometry of the domed PCD table of the PDC. The abrasion resistance may be evaluated by measuring the volume of PDC removed versus the volume of workpiece removed (e.g., Barre granite), while the workpiece is cooled with water in a vertical turret lathe test. Representative test parameters may be a depth of cut for the PDC of about 0.254 mm, a back rake angle for the PDC of about 20 degrees, an in-feed for the PDC of about 6.35 mm/rev, and a rotary speed of the workpiece to be cut of about 101 RPM.

The $G_{ratio}$ is the ratio of volume of PDC removed to volume of workpiece removed during the vertical turret lathe test. According to various embodiments, the $G_{ratio}$ may be about $1\times10^6$ to about $5\times10^7$, such as about $2.5\times10^6$ to about $8\times10^6$, about $7.5\times10^6$ to about $9\times10^6$, about $1\times10^7$ to about $3\times10^7$, at least about $1\times10^7$, at least about $3.5\times10^7$, or about $1\times10^7$ to about $2\times10^7$. The $G_{ratio}$ may decrease as the number of passes (i.e., the distance cut) increases during the vertical turret lathe test. For example, the $G_{ratio}$ may decrease with every fifty passes in the vertical turret lathe test, such as 50, 100, and 150 passes.

Figure 3A:
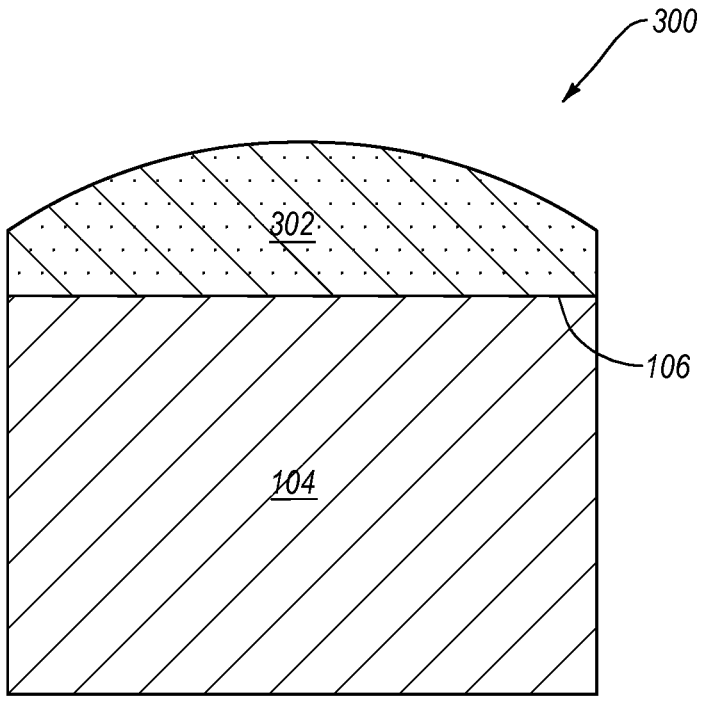
FIGS. 3A and 3B are cross-sectional views at different stages during the fabrication of the PDC shown in FIGS. 1A-1C according to an embodiment of a method.
Figure 3B:
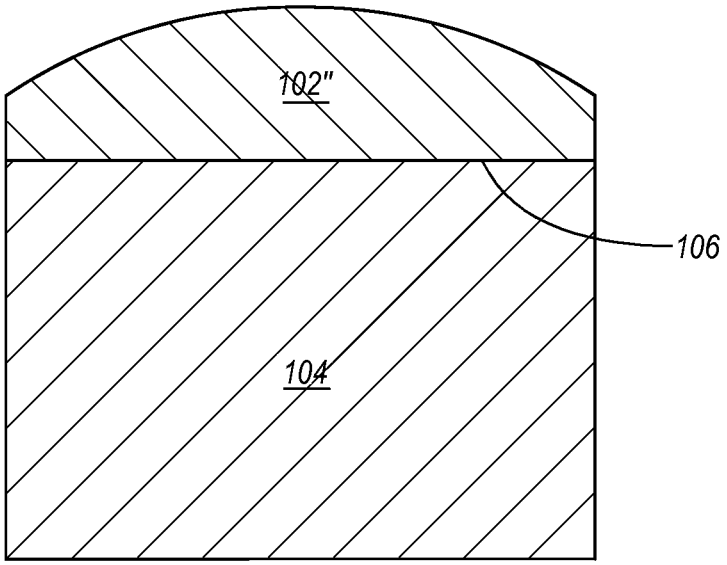

FIGS. 3A and 3B are cross-sectional views at different stages during the fabrication of the PDC 100 shown in FIGS. 1A-1C according to an embodiment of a method. Referring to FIG. 3A, an assembly 300 may be formed by disposing one or more layers 302 of diamond particles adjacent to the interfacial surface 106 of the substrate 104. The plurality of diamond particles of the one or more layers 302 of diamond particles may exhibit one or more selected sizes. The one or more selected sizes may be determined, for example, by passing the diamond particles through one or more sizing sieves or by any other method. In an embodiment, the plurality of diamond particles may include a relatively larger size and at least one relatively smaller size. As used herein, the phrases "relatively larger" and "relatively smaller" refer to particle sizes determined by any suitable method, which differ by at least a factor of two (e.g., 40 μm and 20 μm). In various embodiments, the plurality of diamond particles may include a portion exhibiting a relatively larger size (e.g., 100 μm, 90 μm, 80 μm, 70 μm, 60 μm, 50 μm, 40 μm, 30 μm, 20 μm, 15 μm, 12 μm, 10 μm, 8 μm) and another portion exhibiting at least one relatively smaller size (e.g., 30 μm, 20 μm, 10 μm, 15 μm, 12 μm, 10 μm, 8 μm, 4 μm, 2 μm, 1 μm, 0.5 μm, less than 0.5 μm, 0.1 μm, less than 0.1 μm). In an embodiment, the plurality of diamond particles may include a portion exhibiting a relatively larger size between about 40 μm and about 15 μm and another portion exhibiting a relatively smaller size between about 12 μm and 2 μm. Of course, the plurality of diamond particles may also include three or more different sizes (e.g., one relatively larger size and two or more relatively smaller sizes), without limitation. It should be noted that the as-sintered diamond grain size and distribution may be the same or similar as the precursor diamond particle size and distribution employed.

In some embodiments, non-diamond carbon, such as graphite particles, fullerenes, other non-diamond carbon, or combinations of the foregoing may be mixed with the plurality of diamond particles. The non-diamond carbon substantially converts to diamond during the HPHT fabrication process discussed in more detail below. The presence of the non-diamond carbon during the fabrication of the domed PCD table 102 may enhance the diamond density of the domed PCD table 102 so formed. The non-diamond carbon may be selected to be present in a mixture with the plurality of diamond particles in an amount of about 0.1 weight % ("wt %") to about 20 wt %, such as about 0.1 wt % to about 10 wt %, about 1 wt % to about 9 wt %, about 2 wt % to about 9 wt %, about 3 wt % to about 6 wt %, about 4.5 wt % to about 5.5 wt %, about 5 wt %, about 0.1 wt % to about 0.8 wt %, or about 0.1 wt % to about 0.50 wt %.

When graphite particles are employed for the non-diamond carbon, the graphite particles may exhibit an average particle size of about 1 μm to about 5 μm (e.g., about 1 μm to about 3 μm) so that the graphite particles may fit into interstitial regions defined by the plurality of diamond particles. According to various embodiments, the graphite particles may be crystalline graphite particles, amorphous graphite particles, synthetic graphite particles, or combinations thereof. The term "amorphous graphite" refers to naturally occurring microcrystalline graphite. Crystalline graphite particles may be naturally occurring or synthetic. Various types of graphite particles are commercially available from Ashbury Graphite Mills of Kittanning, Pa.

The assembly 300 including the substrate 104 and the one or more layers 302 of diamond particles may be placed in a pressure transmitting medium, such as a refractory metal can embedded in pyrophyllite or other pressure transmitting medium. In some embodiments, the assembly 300 may be disposed and sealed in a can assembly that helps define the domed shape of the one or more layers 302 of diamond particles. The pressure transmitting medium, including the assembly 300 enclosed therein, may be subjected to an HPHT process using an ultra-high pressure press (e.g., a cubic or belt press) to create temperature and pressure conditions at which diamond is stable. The temperature of the HPHT process may be at least about 1000° C. (e.g., about 1200° C. to about 1600° C.) and the pressure of the HPHT process may be at least 4.0 GPa (e.g., about 5.0 GPa to about 12 GPa or about 7.5 GPa to about 11 GPa) for a time sufficient to sinter the diamond particles to form a PCD table 102" that is shown in FIG. 3B. For example, the pressure of the HPHT process may be about 8 GPa to about 10 GPa and the temperature of the HPHT process may be about 1150° C. to about 1450° C. (e.g., about 1200° C. to about 1400° C.). Upon cooling from the HPHT process, the PCD table 102" becomes bonded (e.g., metallurgically) to the substrate 104. The foregoing pressure values employed in the HPHT process refer to the pressure in the pressure transmitting medium that transfers the pressure from the ultra-high pressure press to the assembly 300. For example, when the HPHT sintering conditions are diamond stable and at about 7.5 GPa cell pressure or higher and the diamond particles have an average particle size of about 30 μm or less, the PCD table 102" so formed may exhibit more extensive diamond-to-diamond bonding and a metal-solvent catalyst content of about 7.5 wt % or less. For example, when fabricated under such ultra-high HPHT conditions, the PCD table 102" may exhibit the magnetic properties, corresponding metal-solvent catalyst contents, and any other characteristic disclosed in U.S. Pat. No. 7,866,418, which is incorporated herein, in its entirety, by this reference.

During the HPHT process, metal-solvent catalyst from the substrate 104 (or other source) may be liquefied and may move into the diamond particles of the one or more layers 302 of diamond particles. For example, cobalt from a cobalt-cemented tungsten carbide substrate may sweep into the diamond particles of the one or more layers 302 of diamond particles. The metal-solvent catalyst functions as a catalyst that catalyzes initial formation of directly bonded-together diamond grains from the diamond particles to form the PCD table 102". The PCD table 102" is comprised of a plurality of directly bonded-together diamond grains, with the metal-solvent catalyst disposed interstitially between the bonded diamond grains.

The domed PCD table 102 shown in FIGS. 1A-1C may be formed by subjecting the PCD table 102" shown in FIG. 3B to a shaping process, such as grinding (e.g., centerless grinding) and/or machining (e.g., electro-discharge machining ("EDM")) to selecting tailor the curvature of the PCD table 102" to define the exterior, convex generally spherical surface 114 having the radius of curvature R. In some embodiments, the exterior, convex generally spherical surface 114 may be initially formed in the PCD table 102" as one or more chamfered surfaces and thereafter shaped to the final geometry shown in FIGS. 1A-1C by grinding and/or machining. The chamfer 116 may be formed before or after the shaping process for forming the exterior, convex generally spherical surface 114 by any of the above-described grinding and/or machining processes. If desired, the PCD table 102" may also be machined to truncate the domed shape of the PCD table 102" to form the PDC 200 shown in FIGS. 2A and 2B, which may reduce the time and/or complexity of the final machining for forming the exterior, convex generally spherical surface 114. In other embodiments, the PCD table 102" may be formed to net shape or near net shape so that only a small amount of post HPHT processing shaping operations are needed to form the PDCs 100 or 200 shown in FIGS. 1A-1C and 2A and 2B.

Figure 4A:
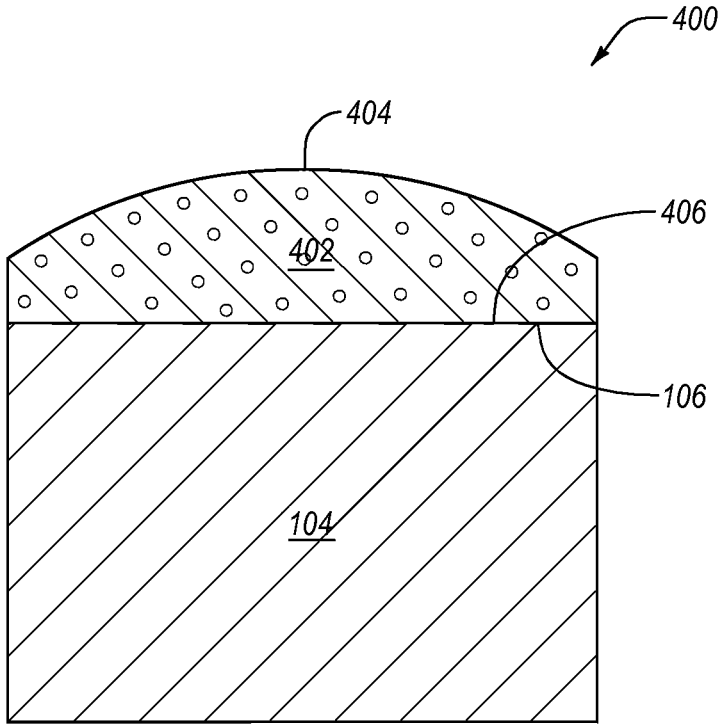
FIGS. 4A and 4B are cross-sectional views at different stages during the fabrication of the PDC shown in FIGS. 1A-1C according to another embodiment of a method.
Figure 4B:
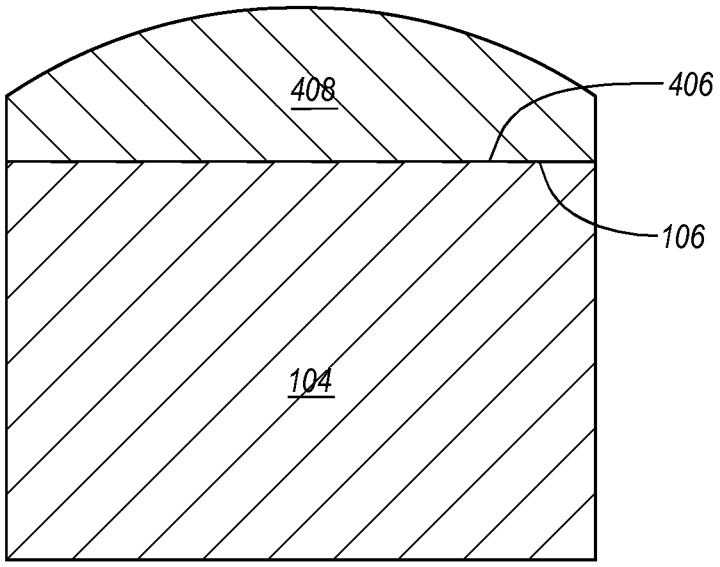

FIGS. 4A and 4B are cross-sectional views at different stages during the fabrication of the PDC 100 shown in FIGS. 1A-1C according to an embodiment of a method for fabricating the PDC 100 that employs a preformed PCD table. Referring to FIG. 4A, an assembly 400 is formed by disposing an at least partially leached PCD table 402 adjacent to the interfacial surface 106 of the substrate 104. The at least partially leached PCD table 402 includes a convex, generally spherical surface 404 and an opposing interfacial surface 406 positioned adjacent to the interfacial surface 106 of the substrate 104. The at least partially leached PCD table 402 includes a plurality of directly bonded-together diamond grains defining interstitial regions that form a network of at least partially interconnected pores, which enables fluid to flow from the substrate interfacial surface 406 to the convex, generally spherical surface 404.

The at least partially leached PCD table 402 may be formed by HPHT sintering a plurality of diamond particles (e.g., with or without a substrate) exhibiting any of the disclosed particle size distributions in the presence of a metal-solvent catalyst, and removing at least a portion of or substantially all the metal-solvent catalyst from sintered PCD body by leaching. The HPHT sintering may be performed using any of the disclosed HPHT process conditions. In some embodiments, any of the disclosed non-diamond carbon materials may be mixed with the plurality of diamond particles in any of the disclosed amounts. For example, the metal-solvent catalyst may be infiltrated into the diamond particles from a metal-solvent catalyst disc (e.g., a cobalt disc), mixed with the diamond particles, infiltrated from a cemented carbide substrate, or combinations of the foregoing. The metal-solvent catalyst may be at least partially removed from the sintered PCD body by immersing the sintered PCD body in an acid, such as aqua regia, nitric acid, hydrofluoric acid, or other suitable acid. For example, the sintered PCD body may be immersed in the acid for about 2 to about 7 days (e.g., about 3, 5, or 7 days) or for a few weeks (e.g., about 4 weeks) depending on the process employed to form the at least partially leached PCD table 402.

The assembly 400 may be placed in a pressure transmitting medium, such as a refractory metal can embedded in pyrophyllite or other pressure transmitting medium. The pressure transmitting medium, including the assembly 400 enclosed therein, may be subjected to an HPHT process using an ultra-high pressure press using any of the disclosed HPHT process conditions so that metallic infiltrant from the substrate 104 (e.g., cobalt from a cobalt-cemented tungsten carbide substrate) is liquefied and infiltrates into the interstitial regions of the at least partially leached PCD table 402. The infiltration may be substantially complete and proceed to the convex, generally spherical surface 404 of the at least partially leached PCD table 402. For example, the pressure of the HPHT process may be about 5 GPa to about 7 GPa and the temperature of the HPHT process may be about 1150° C. to about 1450° C. (e.g., about 1200° C. to about 1400° C.). Upon cooling from the HPHT process, the infiltrated PCD table represented as PCD table 408 in FIG. 4B becomes bonded to the substrate 104.

The domed PCD table 102 shown in FIGS. 1A-1C may be formed by subjecting the convex, generally spherical surface 404 of the infiltrated PCD table 408 to a shaping process, such as centerless grinding and/or EDM, to form the exterior convex, generally spherical surface 114 and the chamfer 116 shown in FIGS. 1A-1C. If desired, the PCD table 408 may also be machined to truncate the domed shape of the PCD table 408 to form the PDC 200 shown in FIGS. 2A and 2B. In other embodiments, the infiltrated PCD table 408 may be formed to net shape or near net shape so that only a small amount of post HPHT processing shaping operations are needed to form the PDCs 100 or 200 shown in FIGS. 1A-1C and 2A and 2B.

Regardless of whether the domed PCD table 102 is integrally formed with the substrate or separately formed and bonded to the substrate in a separate HPHT process, in some embodiments, a replacement material may be infiltrated into interstitial regions of the leached region 118 in a second HPHT process. For example, the replacement material may be disposed adjacent to the exterior convex, generally spherical surface 114, and infiltrate the interstitial regions of the leached region 118 (FIG. 1D) during the second HPHT process. According to various embodiments, the replacement material may be selected from a carbonate (e.g., one or more carbonates of Li, Na, K, Be, Mg, Ca, Sr, and Ba), copper, a copper alloys, aluminum, an aluminum alloy, a sulfate (e.g., one or more sulfates of Be, Mg, Ca, Sr, and Ba), a hydroxide (e.g., one or more hydroxides of Be, Mg, Ca, Sr, and Ba), elemental phosphorous and/or a derivative thereof, a chloride (e.g., one or more chlorides of Li, Na, and K), elemental sulfur, a polycyclic aromatic hydrocarbon (e.g., naphthalene, anthracene, pentacene, perylene, coronene, or combinations of the foregoing) and/or a derivative thereof, a chlorinated hydrocarbon and/or a derivative thereof, a semiconductor material (e.g., germanium or a geranium alloy), and combinations of the foregoing. For example, one suitable carbonate material is an alkali metal carbonate material including a mixture of sodium carbonate, lithium carbonate, and potassium carbonate that form a low-melting ternary eutectic system. This mixture and other suitable alkali metal carbonate materials are disclosed in the aforementioned U.S. patent application Ser. No. 12/185,457. The infiltrated alkali metal carbonate material disposed in the interstitial regions of the leached region 118 may be partially or substantially completely converted to one or more corresponding alkali metal oxides by suitable heat treatment following infiltration.

In another embodiment, the replacement material may include silicon or a silicon-cobalt alloy. The replacement material may at least partially react with the diamond grains of the leached region 118 to form silicon carbide, cobalt carbide, a mixed carbide of cobalt and silicon, or combinations of the foregoing, while unreacted amounts of the replacement material may also remain and include silicon and/or a silicon-cobalt alloy (e.g., cobalt silicide). For example, silicon carbide, cobalt carbide, and a mixed carbide of cobalt and silicon are reaction products that may be formed by the replacement material reacting with the diamond grains of the leached region 118. In an embodiment, the silicon-cobalt replacement material may be present in a layer placed adjacent to the exterior convex, generally spherical surface 114, which includes silicon particles present in an amount of about 50 to about 60 wt % and cobalt particles present in an amount of about 40 to about 50 wt %. In a more specific embodiment, the layer includes silicon particles and cobalt particles present in an amount of about equal to or near a eutectic composition of the silicon-cobalt chemical system. In some embodiments, the silicon particles and cobalt particles may be held together by an organic binder to form a green layer of cobalt and silicon particles. In another embodiment, the layer may include a thin sheet of a silicon-cobalt alloy or a green layer of silicon-cobalt alloy particles formed by mechanical alloying having a low-melting eutectic or near eutectic composition.

In some embodiments, the replacement material may be at least partially removed. For example, an acid leaching process may be used to at least partially remove the replacement material from the PCD table.

Figure 5:
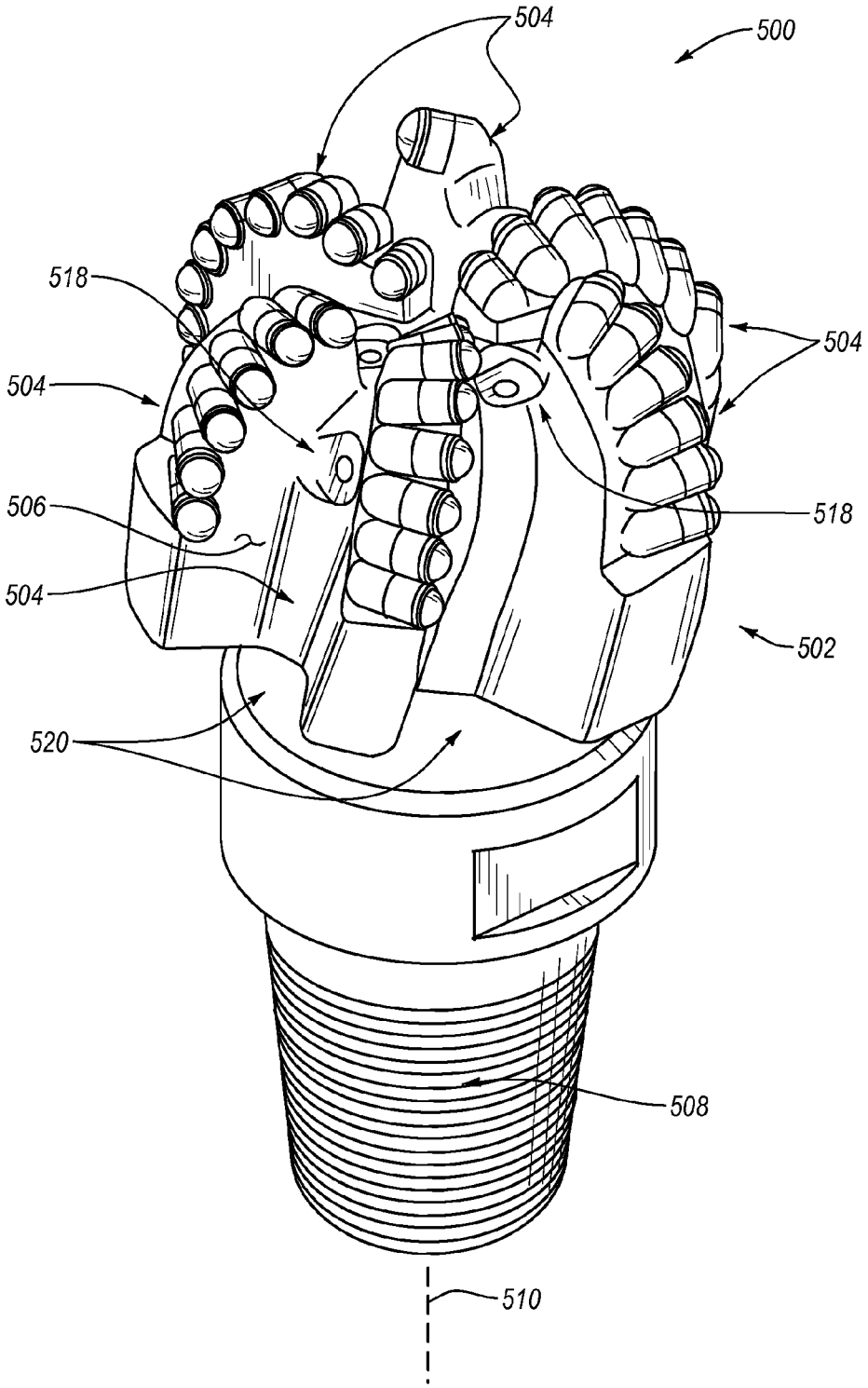
FIG. 5 is an isometric view of an embodiment of a rotary drill bit that may employ one or more of the disclosed PDC embodiments as shear cutters.
Figure 6:
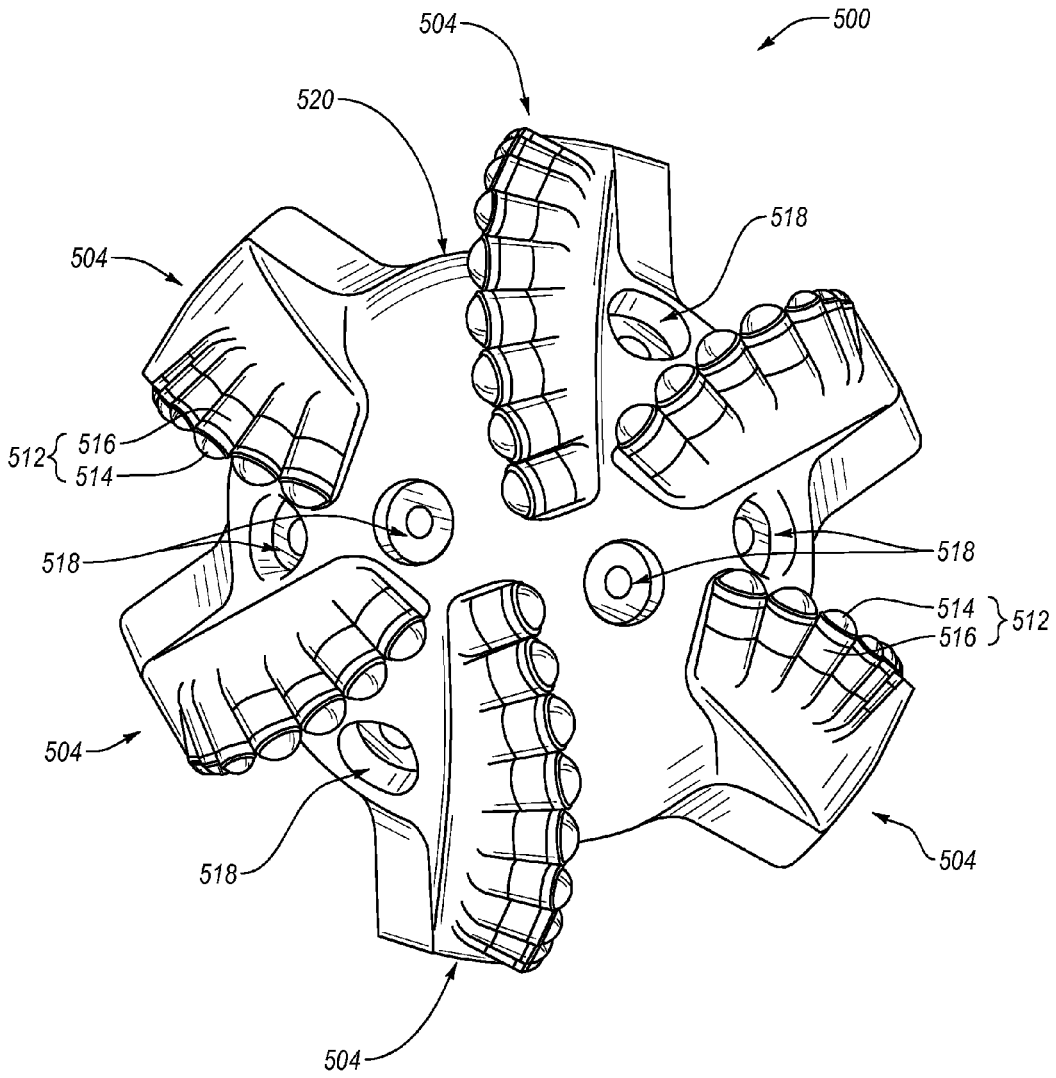
FIG. 6 is a top elevation view of the rotary drill bit shown in FIG. 5.

FIG. 5 is an isometric view and FIG. 6 is a top elevation view of an embodiment of a rotary drill bit 500 that includes at least one PDC configured according to any of the disclosed PDC embodiments. The rotary drill bit 500 includes a bit body 502 that includes radially- and longitudinally-extending blades 504 having leading faces 506, and a threaded pin connection 508 for connecting the bit body 502 to a drilling string. The bit body 502 defines a leading end structure for drilling into a subterranean formation by rotation about a longitudinal axis 510 and application of weight-on-bit. At least one PDC, configured according to any of the disclosed PDC embodiments, may be affixed to the bit body 502. With reference to FIG. 6, each of a plurality of PDCs 512 is secured to the blades 504 of the bit body 502 (FIG. 5) and are positioned and configured to function as shear cutters. For example, each PDC 512 may include a PCD table 514 bonded to a substrate 516. More generally, the PDCs 512 may be configured according to any PDC disclosed herein, without limitation. In addition, if desired, in some embodiments, a number of the PDCs 512 may be conventional in construction. Also, circumferentially adjacent blades 504 define so-called junk slots 520 therebetween. Additionally, the rotary drill bit 500 includes a plurality of nozzle cavities 518 for communicating drilling fluid from the interior of the rotary drill bit 500 to the PDCs 512.

FIGS. 5 and 6 merely depict one embodiment of a rotary drill bit that employs at least one PDC fabricated and structured in accordance with the disclosed embodiments, without limitation. The rotary drill bit 500 is used to represent any number of earth-boring tools or drilling tools, including, for example, core bits, roller-cone bits, eccentric bits, bi-center bits, reamers, reamer wings, or any other downhole tool including PDCs, without limitation.

The following working examples provide further detail in connection with the specific embodiments described above. Comparative working examples 1-3 and 7-10 are compared to working examples 4-6, 11, and 12 fabricated according to specific embodiments of the invention.

Comparative Working Example 1

Six PDCs were formed according to the following process. A mass of diamond particles having an average particle size of about 19 μm was disposed on a cobalt-cemented tungsten carbide substrate. The mass of diamond particles and the cobalt-cemented tungsten carbide substrate were HPHT processed in a high-pressure cubic press at a temperature of about 1400° C. and a cell pressure of about 5 GPa to about 7 GPa to form a PDC comprising a generally cylindrical PCD table integrally formed and bonded to the cobalt-cemented tungsten carbide substrate. The PCD tables were machined to form chamfers thereon. The PCD tables of the six PDCs exhibited a thickness of about 0.0800 inch and a chamfer exhibiting a length of 0.0121 inch at an angle of about 45° with respect to a top planar surface of the PCD table; a thickness of about 0.0852 inch and a chamfer exhibiting a length of 0.0116 inch at an angle of about 45° with respect to a top planar surface of the PCD table; a thickness of about 0.0849 inch and a chamfer exhibiting a length of 0.012 inch at an angle of about 45° with respect to a top planar surface of the PCD table; a thickness of about 0.0782 inch and a chamfer exhibiting a length of 0.011 inch at an angle of about 45° with respect to a top planar surface of the PCD table; a thickness of about 0.0820 inch and a chamfer exhibiting a length of 0.008 inch at an angle of about 45° with respect to a top planar surface of the PCD table; and a thickness of about 0.0844 inch and a chamfer exhibiting a length of 0.011 inch at an angle of about 45° with respect to a top planar surface of the PCD table, respectively.

The abrasion resistance of the conventional PDCs of comparative working example 1 was evaluated by measuring the volume of PDC removed versus the volume of Barre granite workpiece removed, while the workpiece was cooled with water with water in a vertical turret lathe test. The test parameters were a depth of cut for the PDC of about 0.254 mm, a back rake angle for the PDC of about 20 degrees, an in-feed for the PDC of about 6.35 mm/rev, and a rotary speed of the workpiece to be cut of about 101 RPM.

The thermal stability of the PCD table of the conventional PDC of comparative working example 1 was also evaluated by measuring the distance cut in a Barre granite workpiece prior to failure, without using coolant, in a vertical turret lathe test. The distance cut is considered representative of the thermal stability of the PCD table. The test parameters were a depth of cut for the PDC of about 1.27 mm, a back rake angle for the PDC of about 20 degrees, an in-feed for the PDC of about 1.524 mm/rev, and a cutting speed of the workpiece to be cut of about 1.78 msec. Three PDCs of comparative working example 1 were able to cut about 1536 feet, about 1620 feet, and about 1760 feet, respectively, prior to failure in separate thermal stability tests.

Comparative Working Example 2

Two PDCs were formed according to the process described for comparative working example 1. One of the PCD tables of the two PDCs exhibited a thickness of about 0.0897 inch and a chamfer exhibiting a length of 0.0120 inch at an angle of about 45° with respect to a top planar surface of the PCD table, and was leached to a depth of about 219 μm. The other one of the PCD tables exhibited a thickness of about 0.0873 inch and a chamfer exhibiting a length of 0.0112 inch at an angle of about 45° with respect to a top planar surface of the PCD table, and was also leached to a depth of about 219 μm.

The abrasion resistance and thermal stability of the PDCs of comparative working example 2 were tested on the same Bane granite workpiece and using the same test parameters as used with the PDCs of comparative working example 1. One of the PDCs of comparative working example 2 was able to cut at least about 3483 feet in a thermal stability test. The thermal stability test was stopped before failure occurred.

Comparative Working Example 3

Two PDCs was formed according to the process described for comparative working example 1. However, the HPHT processing cell pressure was about 7.7 GPa. One of the PCD tables exhibited a thickness of about 0.0797 inch and a chamfer exhibiting a length of 0.0121 inch at an angle of about 45° with respect to a top planar surface of the PCD table. One of the PCD tables exhibited a thickness of about 0.08265 inch and a chamfer exhibiting a length of 0.0120 inch at an angle of about 45° with respect to a top planar surface of the PCD table. The PCD tables were leached not leached unlike comparative working example 2.

The abrasion resistance and thermal stability of the PDCs of comparative working example 3 were tested on the same Barre granite workpiece and using the same test parameters as used with the PDCs of comparative working example 1. One of the PDCs of comparative working example 3 was able to cut about 1869 feet, prior to failure, in a thermal stability test.

Working Example 4

Six PDCs were formed according to the following process. A mass of diamond particles having an average particle size of about 19 μm was disposed in a spherically concave canister, with a cobalt-cemented tungsten carbide substrate disposed on the mass of diamond particles, to form a can assembly. The can assembly, including the mass of diamond particles and the cobalt-cemented tungsten carbide substrate, were HPHT processed in a high-pressure cubic press at a temperature of about 1400° C. and a cell pressure of about 5 GPa to about 7 GPa to form a PDC comprising a domed PCD table integrally formed and bonded to the cobalt-cemented tungsten carbide substrate. The domed PCD tables were machined to form chamfers thereon between the domed portion and generally cylindrical portion. The domed PCD tables were generally configured as shown in FIGS. 1A-1C.

The domed PCD tables of the six PDCs exhibited a maximum thickness T of about 0.0935 inch, a chamfer exhibiting a lateral extent and an extension depth of about 0.0128 inch at an angle of about 45°, and a radius of curvature R of the domed portion of the PCD table of about 0.783 inch; a maximum thickness T1 of about 0.0969 inch, a chamfer exhibiting a lateral extent and an extension depth of about 0.0129 inch at an angle of about 45°, and a radius of curvature R of the domed portion of the PCD table of about 0.783 inch; a maximum thickness T1 of about 0.0925 inch, a chamfer exhibiting a lateral extent and an extension depth of about 0.0119 inch at an angle of about 45°, and a radius of curvature R of the domed portion of the PCD table of about 0.783 inch; a maximum thickness T1 of about 0.0911 inch, a chamfer exhibiting a lateral extent and an extension depth of about 0.0102 inch at an angle of about 45°, and a radius of curvature R of the domed portion of the PCD table of about 0.783 inch; a maximum thickness T1 of about 0.0973 inch, a chamfer exhibiting a lateral extent and an extension depth of about 0.0116 inch at an angle of about 45°, and a radius of curvature R of the domed portion of the PCD table of about 0.783 inch; and a maximum thickness T1 of about 0.0932 inch, a chamfer exhibiting a lateral extent and an extension depth of about 0.0101 inch at an angle of about 45°, and a radius of curvature R of the domed portion of the PCD table of about 0.783 inch, respectively.

The abrasion resistance and thermal stability of the PDCs of working example 4 were tested on the same Barre granite workpiece and using the same test parameters as used with the PDCs of comparative working example 1. Three PDCs of working example 4 were able to cut about 1530 feet, about 1824 feet, and about 2060 feet, respectively, prior to failure in separate thermal stability tests.

Working Example 5

Six PDCs were formed according to the process described for working example 4. However, the domed PCD tables had different geometries than the PDCs of working example 4.

The domed PCD tables of the six PDCs exhibited a maximum thickness T of about 0.102 inch, a chamfer exhibiting a lateral extent D1 and an extension depth of about 0.010 inch at an angle of about 45°, and a radius of curvature R of the domed portion of the PCD table of about 0.574 inch; a maximum thickness T1 of about 0.0975 inch, a chamfer exhibiting a lateral extent and an extension depth of about 0.0112 inch at an angle of about 45°, and a radius of curvature R of the domed portion of the PCD table of about 0.574 inch; a maximum thickness T1 of about 0.102 inch, a chamfer exhibiting a lateral extent and an extension depth of about 0.0124 inch at an angle of about 45°, and a radius of curvature R of the domed portion of the PCD table of about 0.574 inch; a maximum thickness T1 of about 0.105 inch, a chamfer exhibiting a lateral extent and an extension depth of about 0.008 inch at an angle of about 45°, and a radius of curvature R of the domed portion of the PCD table of about 0.574 inch; a maximum thickness T1 of about 0.100 inch, a chamfer exhibiting a lateral extent and an extension depth of about 0.0104 inch at an angle of about 45°, and a radius of curvature R of the domed portion of the PCD table of about 0.574 inch; and a maximum thickness T1 of about 0.100 inch, a chamfer exhibiting a lateral extent and an extension depth of about 0.0111 inch at an angle of about 45°, and a radius of curvature R of the domed portion of the PCD table of about 0.574 inch, respectively.

The abrasion resistance and thermal stability of the PDCs of working example 5 were tested on the same Barre granite workpiece and using the same test parameters as used with the PDCs of comparative working example 1. Three PDCs of working example 5 were able to cut about 2213 feet, about 2366 feet, and about 2427 feet, respectively, prior to failure in separate thermal stability tests.

Working Example 6

Six PDCs were formed according to the process described for working example 4. However, each of the domed PCD tables had different geometries than the PDCs of working example 4 and no chamfer between the domed portion and the generally cylindrical portion thereof.

The domed PCD tables of the six PDCs exhibited a maximum thickness T1 of about 0.0800 inch and a radius of curvature R of the domed portion of the PCD table of about 0.466 inch; a maximum thickness T1 of about 0.091 inch and a radius of curvature R of the domed portion of the PCD table of about 0.466 inch; a maximum thickness T1 of about 0.092 inch and a radius of curvature R of the domed portion of the PCD table of about 0.466 inch; a maximum thickness T1 of about 0.0828 inch and a radius of curvature R of the domed portion of the PCD table of about 0.466 inch; a maximum thickness T1 of about 0.084 inch and a radius of curvature R of the domed portion of the PCD table of about 0.466 inch; and a maximum thickness T1 of about 0.089 inch and a radius of curvature R of the domed portion of the PCD table of about 0.466 inch, respectively.

The abrasion resistance and thermal stability of the PDCs of working example 6 were tested on the same Barre granite workpiece and using the same test parameters as used with the PDCs of comparative working example 1. Three PDCs of working example 6 were able to cut about 1250 feet, about 2087 feet, and about 2330 feet, respectively, prior to failure in separate thermal stability tests.

Abrasion Resistance and Thermal Stability Test Results for Working Examples 1-6

Figure 7:
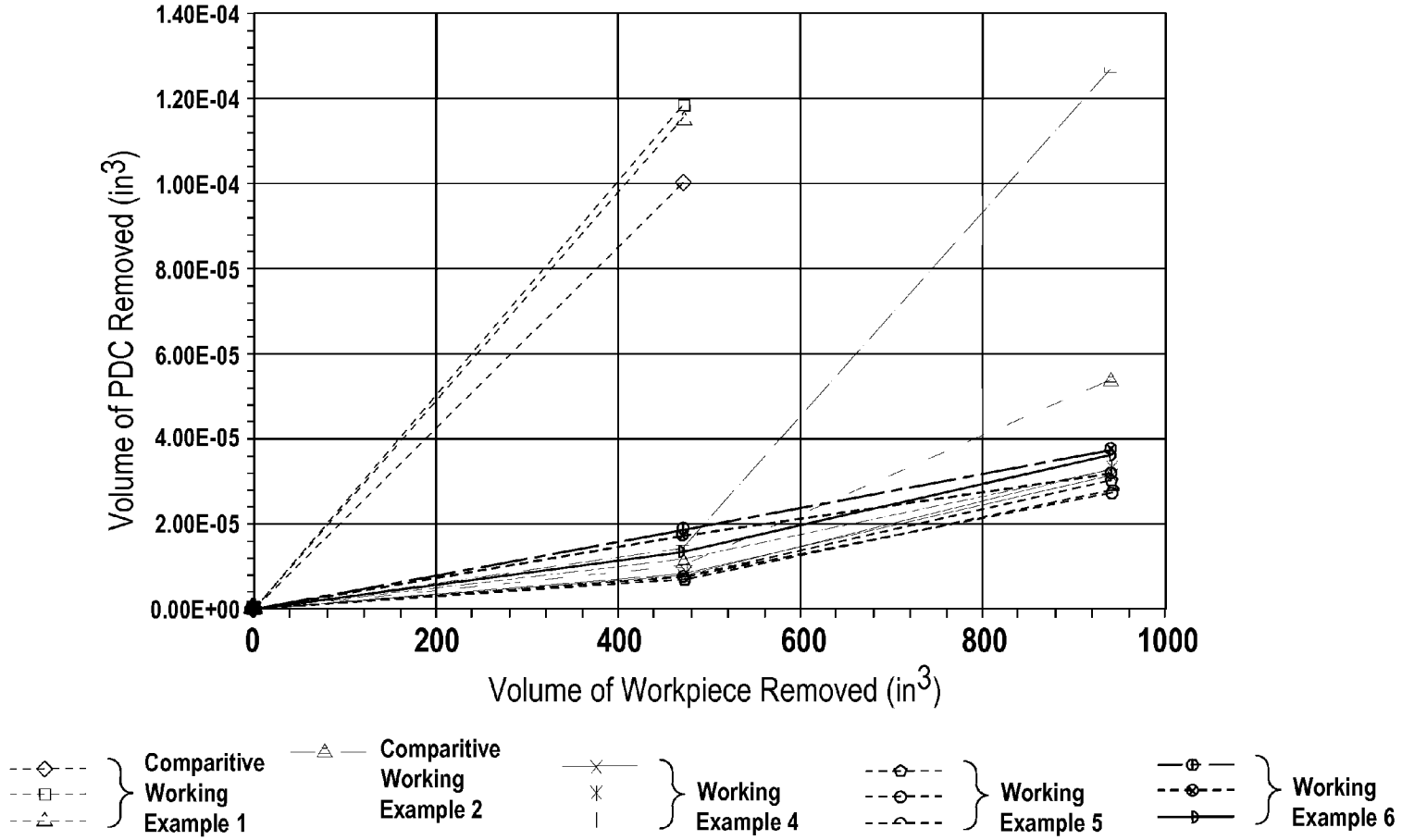
FIG. 7 is a graph of volume of PDC removed versus distance cut from abrasion resistance tests for various tested PDCs of comparative working examples 1-3 and working examples 4-6 according to the invention.

FIG. 7 shows the abrasion resistance test results for the various tested PDCs. As shown in FIG. 7, the PDCs of working examples 4-6 according to the invention had a greater abrasion resistance than any of the conventional PDCs of comparative working examples 1-3 including the leached PDC of comparative working example 2. Additionally, the thermal stability test results briefly discussed above demonstrated that the unleached PDCs of working examples 4-6 according to the invention exhibited very high thermal stability despite being unleached. It is currently hypothesized by the inventors that with shallow leaching of the PCD tables of the PDCs of working examples 4-6, their respective thermal stability may be at least as high as (if not greater than) that of the leached PDC of comparative working example 2.

Comparative Working Example 7

A PDC was formed according to process described for comparative working example 3 in order to form a PDC comprising a generally cylindrical PCD table integrally formed and bonded to the cobalt-cemented tungsten carbide substrate. The PCD tables were machined to form chamfers thereon. The PCD table of the PDC exhibited a thickness of about 0.0801 inch and a chamfer exhibiting a length of 0.0112 inch at an angle of about 45° with respect to a top planar surface of the PCD table.

The abrasion resistance of the conventional PDC of comparative working example 8 was evaluated by measuring the volume of PDC removed versus the volume of Barre granite workpiece removed, while the workpiece was cooled with water. The test parameters were a depth of cut for the PDC of about 0.254 mm, a back rake angle for the PDC of about 20 degrees, an in-feed for the PDC of about 6.35 mm/rev, and a rotary speed of the workpiece to be cut of about 101 RPM.

Comparative Working Example 8

A PDC were formed according to the process described for comparative working example 1. The PCD table of the PDC exhibited a thickness of about 0.0906 inch and a chamfer exhibiting a length of 0.0122 inch at an angle of about 45° with respect to a top planar surface of the PCD table, and was leached to a depth of about 325 μm. The abrasion resistance of the PDC of comparative working example 8 was tested on the same Barre granite workpiece and using the same test parameters as used with the PDC of comparative working example 7.

Comparative Working Example 9

Two PDC was formed according to the following process. A generally cylindrical PCD table was formed by HPHT sintering diamond particles having an average grain size of about 19 μm on a cobalt-cemented tungsten carbide substrate in a high-pressure cubic press at a temperature of about 1400° C. and a cell pressure of about 5 GPa to about 7 GPa to form a precursor PDC. The PCD table of the precursor PDC included bonded diamond grains, with cobalt disposed within interstitial regions between the bonded diamond grains. The cobalt-cemented tungsten carbide substrate was removed from the PCD table by grinding. The separated PCD table was leached with acid for a time sufficient to remove substantially all of the cobalt from the interstitial regions to form an at least partially leached PCD table. The at least partially leached PCD table was placed adjacent to a cobalt-cemented tungsten carbide substrate. The at least partially leached PCD table and a cobalt-cemented tungsten carbide substrate were HPHT processed in a high-pressure cubic press at a temperature of about 1400° C. and a pressure of about 5 GPa to about 7 GPa to form a PDC comprising a generally cylindrical infiltrated PCD table bonded to the cobalt-cemented tungsten carbide substrate. The PCD tables of the two PDCs exhibited a thickness of about 0.0728 inch and a chamfer exhibiting a length of 0.0114 inch at an angle of about 45° with respect to a top planar surface of the PCD table; and a thickness of about 0.0769 inch and a chamfer exhibiting a length of 0.0114 inch at an angle of about 45° with respect to a top planar surface of the PCD table, respectively. The abrasion resistance of the PDCs of comparative working example 9 was tested on the same Bane granite workpiece and using the same test parameters as used with the PDC of comparative working example 7.

Comparative Working Example 10

Three PDCs were formed according to the process described for comparative working example 9. However, the infiltrated PCD tables of the three PDCs were each leached in acid to substantially remove the cobalt that re-infiltrated the at least partially leached PCD table from a selected region thereof. The infiltrated PCD tables of the three PDCs exhibited a thickness of about 0.0837 inch and a chamfer exhibiting a length of 0.0122 inch at an angle of about 45° with respect to a top planar surface of the PCD table and was leached to a depth of about 150 μm to about 250 μm; a thickness of about 0.084 inch and a chamfer exhibiting a length of 0.0118 inch at an angle of about 45° with respect to a top planar surface of the PCD table and was leached to a depth of about 150 μm to about 250 μm; and a thickness of about 0.0868 inch and a chamfer exhibiting a length of 0.0115 inch at an angle of about 45° with respect to a top planar surface of the PCD table and was leached to a depth of about 150 μm to about 250 μm, respectively. The abrasion resistance of the PDCs of comparative working example 10 was tested on the same Bane granite workpiece and using the same test parameters as used with the PDC of comparative working example 7.

Working Example 11

Two PDCs were formed according to the process described for comparative working example 9. However, the at least partially leached PCD tables were configured similar to the at least partially leached PCD table 402 shown in FIG. 4A and the infiltrated PCD tables of the two PDCs were formed to have a domed geometry similar to that of the PCD table 102 shown in FIGS. 1A-1C. After re-infiltration of the at least partially leached domed PCD tables, the infiltrated domed PCD tables were subjected to final machining to form a selected radius of curvature and chamfer thereon. The infiltrated domed PCD tables of the two PDCs exhibited a maximum thickness T1 of about 0.0717 inch, a chamfer exhibiting a lateral extent and an extension depth of about 0.011 inch at an angle of about 45°, and a radius of curvature R of the domed portion of the domed infiltrated PCD table of about 2.268 inch; and a maximum thickness T1 of about 0.0833 inch, a chamfer exhibiting a lateral extent and an extension depth of about 0.013 inch at an angle of about 45°, and a radius of curvature R of the domed infiltrated portion of the PCD table of about 2.268 inch, respectively. The abrasion resistance of the two PDCs of working examples 11 was tested on the same Barre granite workpiece and using the same test parameters as used with the PDC of comparative working example 7.

Working Example 12

Three PDCs were formed according to the process described for comparative working example 9. However, the at least partially leached PCD tables were configured similar to the at least partially leached PCD table 402 shown in FIG. 4A and the infiltrated PCD tables of the two PDCs were formed to have a domed geometry similar to that of the PCD table 102 shown in FIGS. 1A-1C. After re-infiltration of the at least partially leached domed PCD tables, the infiltrated domed PCD tables were subjected to final machining to form a selected radius of curvature and chamfer therein. The infiltrated domed PCD tables of the three PDCs exhibited a maximum thickness T1 of about 0.0821 inch, a chamfer exhibiting a lateral extent and an extension depth of about 0.013 inch at an angle of about 45°, and a radius of curvature R of the domed infiltrated portion of the PCD table of about 2.268 inch; a maximum thickness T1 of about 0.079 inch, a chamfer exhibiting a lateral extent and an extension depth of about 0.0129 inch at an angle of about 45°, and a radius of curvature R of the domed infiltrated portion of the PCD table of about 2.268 inch; and a maximum thickness T1 of about 0.0819 inch, a chamfer exhibiting a lateral extent and an extension depth of about 0.0119 inch at an angle of about 45°, and a radius of curvature R of the domed infiltrated portion of the PCD table of about 2.268 inch, respectively. The infiltrated domed PCD tables of the three PDCs were leached for about the same amount of time in the same acid bath to form a leached region therein similar to that shown by the leached region 118 in FIG. 1D.

The abrasion resistance of the three PDCs of working examples 12 was tested on the same Barre granite workpiece and using the same test parameters as used with the PDC of comparative working example 7.

Abrasion Resistance Test Results for Working Examples 7-12

Figure 8:
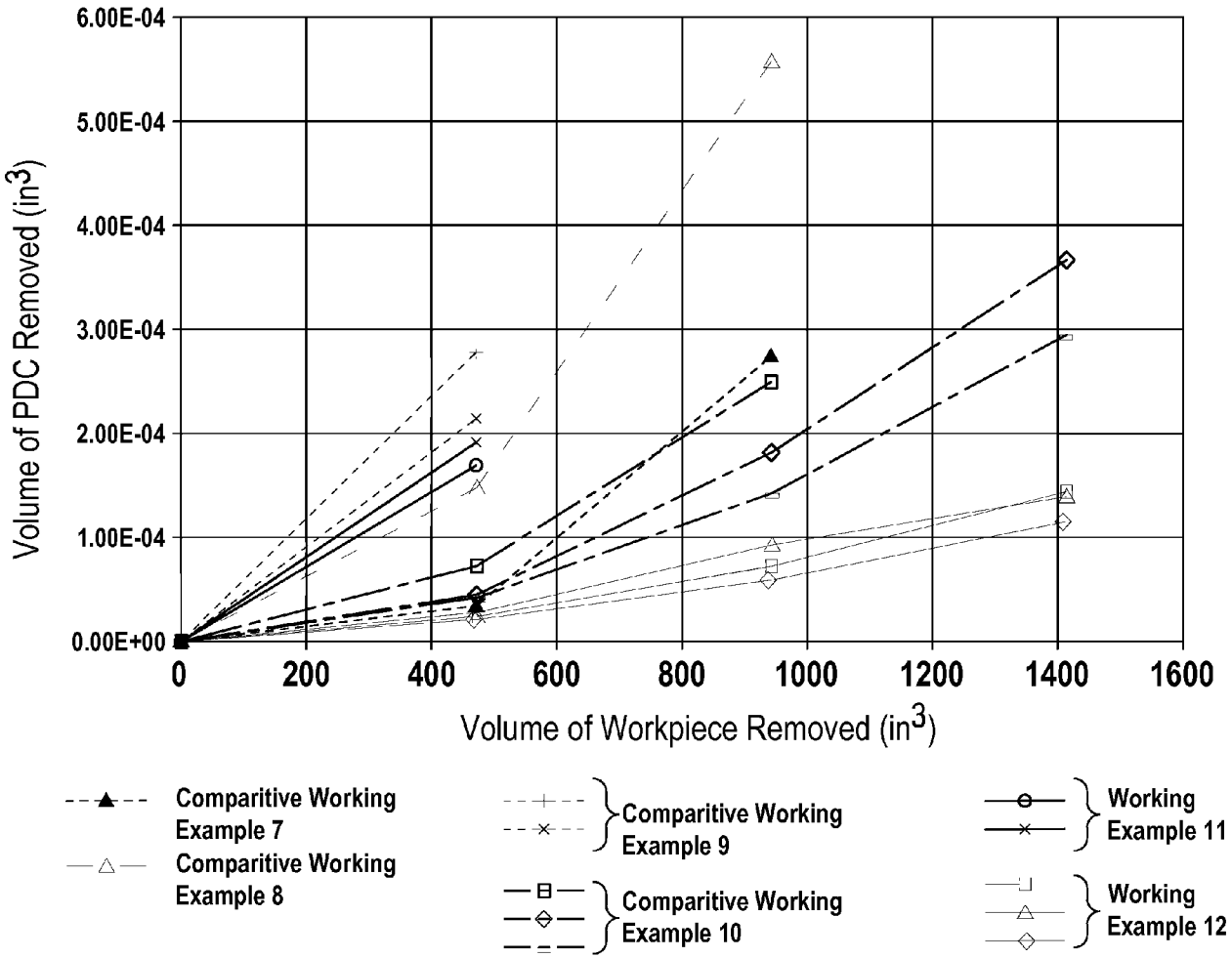
FIG. 8 is graph of volume of PDC removed versus distance cut from abrasion resistance tests for various tested PDCs of comparative working examples 7-10 and working examples 11 and 12 according to the invention.

FIG. 8 shows the abrasion resistance test results for the various tested PDCs of comparative working examples 7-10 and working examples 11 and 12 according to the invention. As shown in FIG. 8, the un-leached PDCs of working example 11 according to the invention had an abrasion resistance similar to that of the leached PDCs of comparative working example 8. The leached PDCs of working example 12 according to the invention had the best abrasion resistance of all of the PDCs from working examples 7-12. The abrasion resistance of the leached PDCs of working example 12 according to the invention was even superior to that of the leached PDCs of comparative working example 10 indicating that the domed geometry of the PCD table of working example 12 may help increase the abrasion resistance compared to the generally cylindrical geometry of the leached PCD table of comparative working example 10.

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall be open ended and have the same meaning as the word "comprising" and variants thereof (e.g., "comprise" and "comprises").

What is claimed is:

1. A polycrystalline diamond compact, comprising:

a substrate including an interfacial surface; and a domed polycrystalline diamond table bonded to the interfacial surface of the substrate, the domed polycrystalline diamond table including:

an exterior, convex generally cylindrical peripheral surface extending away from the interfacial surface of the substrate;

a domed portion defining an upper, convex generally spherical surface; and a chamfer extending between the exterior, convex generally cylindrical peripheral surface and the upper, convex generally spherical surface;

wherein the domed polycrystalline diamond table exhibits a maximum thickness;

wherein the upper, convex generally spherical surface exhibits a radius of curvature of about 0.400 inch to about 0.800 inch; and wherein a ratio of the radius of curvature to the maximum thickness is about 2 to about 7.

2. The polycrystalline diamond compact of claim 1 wherein the domed polycrystalline diamond table is integrally formed with the substrate.

3. The polycrystalline diamond compact of claim 1 wherein the domed polycrystalline diamond table includes a preformed domed polycrystalline diamond table.

4. The polycrystalline diamond compact of claim 1 wherein the chamfer intersects the exterior, convex generally cylindrical peripheral surface and the upper, convex generally spherical surface of the domed portion.

5. The polycrystalline diamond compact of claim 1 wherein the ratio is about 3 to about 5.

6. The polycrystalline diamond compact of claim 1 wherein the maximum thickness is less than the radius of curvature, wherein the maximum thickness is measured from an apex of the upper, convex generally spherical surface to a portion of the exterior, convex generally cylindrical peripheral surface that contacts the interfacial surface of the substrate.

7. The polycrystalline diamond compact of claim 1 wherein the chamfer of the domed polycrystalline diamond table includes an extension depth that extends axially and a lateral extent, a ratio of the extension depth to the lateral extent is about 0.5 to about 2.

8. The polycrystalline diamond compact of claim 7 wherein the ratio of the extension depth to the lateral extent is about 1 to about 2.

9. The polycrystalline diamond compact of claim 1 wherein the domed portion of the domed polycrystalline diamond table includes a substantially planar exterior surface from which the upper, convex generally spherical surface extends toward the substrate.

10. The polycrystalline diamond compact of claim 9 wherein the substantially planar exterior surface is generally centrally located.

11. The polycrystalline diamond compact of claim 1 wherein the interfacial surface of the substrate is substantially planar.

12. The polycrystalline diamond compact of claim 1 wherein the domed polycrystalline diamond table includes a leached region that extends inwardly from the upper, convex generally spherical surface of the domed portion thereof.

13. The polycrystalline diamond compact of claim 12 wherein the leached region extends inwardly from at least a portion of the chamfer.

14. The polycrystalline diamond compact of claim 13 wherein the leached region extends inwardly from the exterior generally cylindrical peripheral surface.

15. The polycrystalline diamond compact of claim 1 wherein the domed polycrystalline diamond table exhibits a $G_{ratio}$ of about $1\times10^6$ to about $5\times10^7$, the $G_{ratio}$ being defined by the ratio of the volume of polycrystalline diamond compact removed to the volume of workpiece removed while the workpiece is cooled with water in a vertical turret lathe test.

16. The polycrystalline diamond compact of claim 15 wherein the domed polycrystalline diamond table exhibits a $G_{ratio}$ of about $7.5\times10^6$ to about $9\times10^6$.

17. The polycrystalline diamond compact of claim 1 wherein the chamfer is defined by a lateral extent and an extension depth that extends in an axial direction of the polycrystalline diamond compact; and wherein each of the lateral extent and the extension depth is about 0.010 inch to about 0.025 inch.

18. The polycrystalline diamond compact of claim 1 wherein the radius of curvature is about 0.400 inch to about 5.0 inch.

19. The polycrystalline diamond compact of claim 18 wherein the radius of curvature is about 0.400 inch to about 0.700 inch.

20. A rotary drill bit, comprising:

a bit body configured to engage a subterranean formation, the bit body including a plurality of blades; and a plurality of polycrystalline diamond cutting elements, each of the plurality of polycrystalline diamond cutting elements affixed to one of the plurality of blades, at least one of the polycrystalline diamond cutting elements including:

a substrate including an interfacial surface; and a domed polycrystalline diamond table bonded to the interfacial surface of the substrate, the domed polycrystalline diamond table including:

an exterior, convex generally cylindrical peripheral surface extending away from the interfacial surface of the substrate;

a domed portion including an upper, convex generally spherical surface; and a chamfer extending between the exterior, convex generally cylindrical peripheral surface and the upper, convex generally spherical surface;

wherein the domed polycrystalline diamond table exhibits a maximum thickness;

wherein the upper, convex generally spherical surface exhibits a radius of curvature of about 0.400 inch to about 0.800 inch; and wherein a ratio of the radius of curvature to the maximum thickness is about 2 to about 7.

21. The rotary drill bit of claim 20 wherein the at least one of the polycrystalline diamond cutting elements is positioned and configured as a fixed shear cutter.

22. A rotary drill bit, comprising:

a bit body configured to engage a subterranean formation, the bit body including a plurality of blades; and a plurality of polycrystalline diamond shear cutting elements, each of the plurality of polycrystalline diamond shear cutting elements affixed to one of the plurality of blades, at least one of the polycrystalline diamond shear cutting elements including:

a substrate including an interfacial surface; and a domed polycrystalline diamond table bonded to the interfacial surface of the substrate, the domed polycrystalline diamond table including:

an exterior, convex generally cylindrical peripheral surface extending away from the interfacial surface of the substrate; and a domed portion including an upper, convex generally spherical surface;

wherein the domed polycrystalline diamond table exhibits a maximum thickness;

wherein the upper, convex generally spherical surface exhibits a radius of curvature of about 0.400 inch to about 0.800 inch; and wherein a ratio of the radius of curvature to the maximum thickness is about 2 to about 7.

* * * * *